United States Patent [19]

Fargnier

[11] Patent Number: 4,845,811

[45] Date of Patent: Jul. 11, 1989

[54] AUTOMATIC DOOR CLOSER HAVING AN ADJUSTABLE TORSION SPRING AND CONFIGURED END FITTINGS

[76] Inventor: Jean A. Fargnier, 30-32, rue Roger Salengro, Fontenay Sous Bois (Val de Marne) 94120, France

[21] Appl. No.: 149,134

[22] Filed: Jan. 27, 1988

[30] Foreign Application Priority Data

Feb. 6, 1987 [FR] France ..... 87 01462

[51] Int. Cl.[4] ..... E05F 1/08

[52] U.S. Cl. ..... 16/308; 16/301; 16/75

[58] Field of Search ..... 16/75, 76, 300, 301, 16/307, 308, DIG. 36; 267/154, 273, 284

[56] References Cited

U.S. PATENT DOCUMENTS 416,044 11/1889 Wise ..... 16/308

518,639 4/1894 Wilson ..... 16/301

2,908,050 10/1959 Sullivan et al. ..... 16/75 X 3,022,536 2/1962 Floehr ..... 16/308

3,209,391 10/1965 Mangini ..... 16/75 X

*Primary Examiner*—Fred A. Silverberg

*Attorney, Agent, or Firm*—Wolf, Greenfield & Sacks

[57] ABSTRACT

Spring closing device for door or the like, comprising at least two hinges, each one comprising two components articulated on an axis and one of which, known as the mobile component, is fixed on the door and the other of which, known as the fixed component, is fixed on the post of this door, whereby a flexible spring torsion bar is also provided between this door and its post so as to bring it back automatically into the closed position, a device characterized in that the elastic component comprises a steel spring torsion bar (6) connecting the fixed component of a hinge to the mobile component of another hinge.

1 Claim, 2 Drawing Sheets

AUTOMATIC DOOR CLOSER HAVING AN ADJUSTABLE TORSION SPRING AND CONFIGURED END FITTINGS

BACKGROUND OF THE INVENTION

The invention relates to a spring closing device for a door or the like.

A closing device of this type, the torsion bar of which connects the fixed component of a hinge of a door to the mobile component of another hinge of this door via intermediate components, is already known from U.S. Pat. No. 3,209,391.

In the case of this product, the torsion bar and the intermediate parts are surrounded by a decorative and protective tube.

However, on this door closing device and as on all the devices of this type which have been produced to date, the initial tension or torsion of the bar is produced, when the decorative and protective tube is already in position on the torsion bar, which necessarily implies that the reverse operations may be carried out with malicious intent, thus eliminating the effect of automatically closing the door.

SUMMARY OF THE INVENTION

The object of the present invention is particularly to eliminate these disadvantages and covers for this purpose a spring closing device characterised in that a tube provided with a slot along its length is disposed about the bar between the hinges, whereby this tube is held coaxially on the bar by cores or washers adjacent to the hinges and whereby the bar passes freely inside at least one of these cores or washers so that end fittings can be displaced by sliding on the bar inside the tube.

According to a characteristic of the invention it comprises end pieces provided with a passage, inside which the torsion bar can be immobilised.

BRIEF DESCRIPTION OF THE DRAWINGS

An example of the invention is shown on a non-restrictive basis in the attached drawings, in which.

DESCRIPTION OF THE PREFERRED EMBODIMENTS

The object of the present invention is, therefore, to produce a spring closing device of simple construction, which is easy to fit, which operates reliably, which takes up little space and which is constructed so that it is practically impossible for the door to be put out of order as a result of vandalism on the part of those without any knowledge of its special type of construction.

Figure 1:
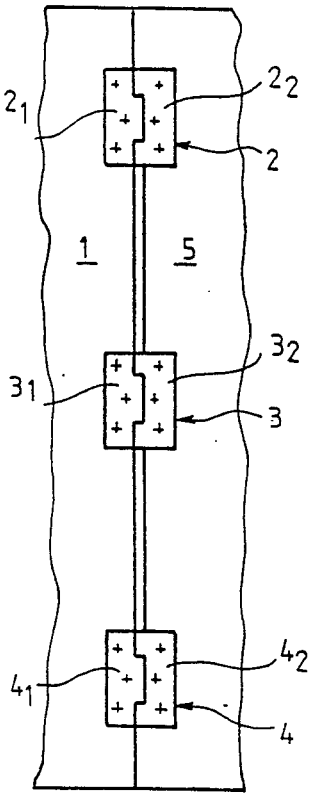
FIG. 1 shows a front view of an example of the hinging arrangement of a door with three hinges.
Figure 2:
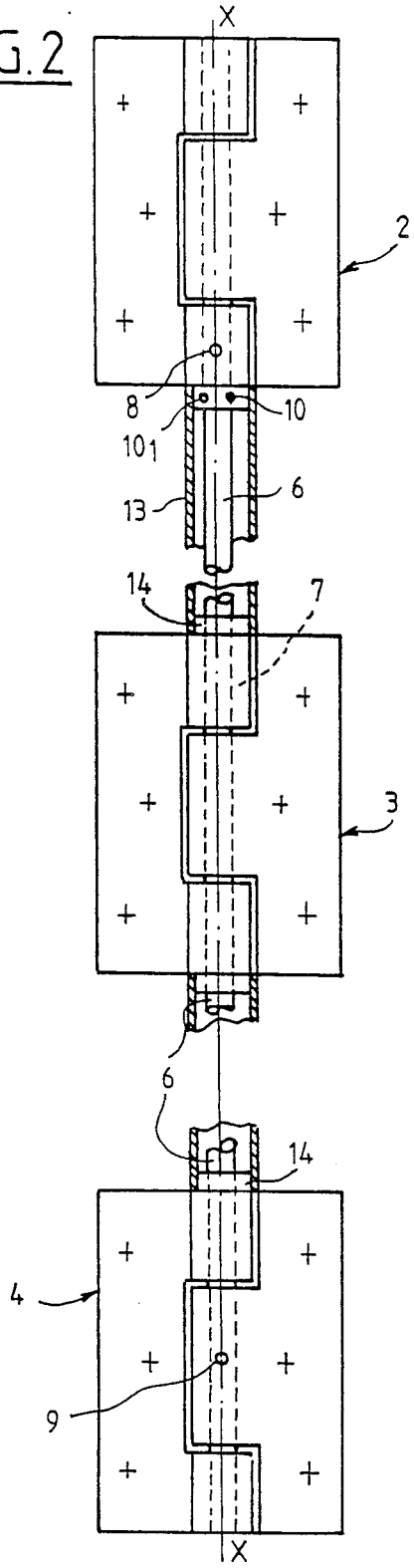
FIG. 2 shows a broken down view of the three hinges of FIG. 1.
Figure 3:
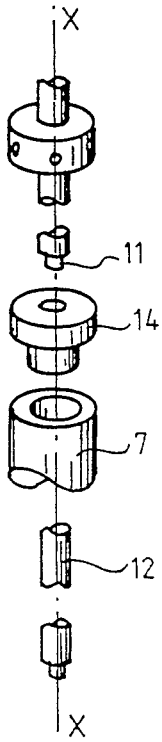
FIG. 3 shows a view in perspective of various parts associated with the hinges shown in FIG. 2.

According to the method of construction shown in FIGS. 1 to 3, a door is illustrated, the leaf 1 of which is fitted so that it is hinged with three hinges 2, 3 and 4 on a post 5 of the door frame. Each hinge therefore comprises a mobile component $2_1$, $3_1$, $4_1$, which is fixed on the door panel 1 and a fixed component $2_2$, $3_2$ and $4_2$ which is fixed on the post 5 of the door frame.

According to the invention, the door is automatically returned to the closed position by a steel spring bar 6 which applies torsion and which connects the node of the fixed component of a hinge to the node of the mobile component of the other hinge.

In the example shown in FIG. 2, the torsion bar 6 passes freely through the hollow spindle 7 of the intermediate hinge 3 and its upper end penetrates inside the node of the mobile component $2_1$, inside which it is rotationally immobilised by a retaining screw 8.

In the same way the lower end of the torsion bar 6 passes freely through a portion of the hollow spindle, through the node of the mobile component of the lower hinge 4 and is fixed to the inside of the node of the mobile component with a retaining screw 9. In this way the torsional moment of the bar is applied between a fixed component of a hinge and the mobile component of another hinge so as to bring the door back automatically into the closed position.

The torsion bar 6 is integral with a pin 10 located near its upper end in a position adjacent to the hinge 2. This pin 10 is provided with radial perforations $10_1$. These perforations are designed to receive a tool with which torsion can be applied to the bar 6 before it is locked with the retaining screw 8. This initial torsion determines the restoring torque of the door into the rest position i.e. the torque which prevents untimely banging of the door panel.

To facilitate the fitting of the torsion bar, it is preferably made in two parts, whereby each part is fitted together with a joint by mortise 12 and 10 and tenon 11 and whereby this joint is preferably disposed at the height of the intermediate hinge 3, so that it can be concealed inside this hinge.

Moreover, the torsion bar 6 is housed between the hinges inside tubes 13, which are slit along their length and which are designed to conceal the torsion bar and prevent it from being damaged by vandalism. The width of the slot is chosen so that the tube can be put in position on the bench passing through this slot.

These tubes 13 are held coaxially in relation to the bar 6, between the hinges with cylindrical pins 14 which are fitted on in the upper and lower ends of the nodes of the hinges. These pins 14 are provided with openings, in which the torsion bar 6 passes freely. One of these pins 14 shall in effect be formed by the pin 10 for the initial tension of the bar and this pin shall therefore also be concealed after the tubes 13 have been fitted.

Figure 4:
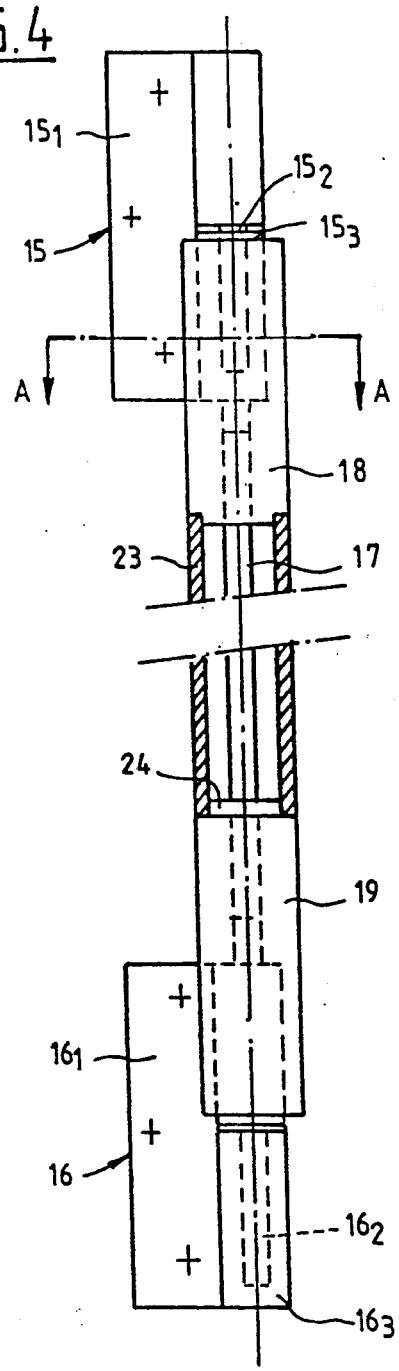
FIG. 4 shows a partially sectional side view of another method of constructing the device.
Figure 5:
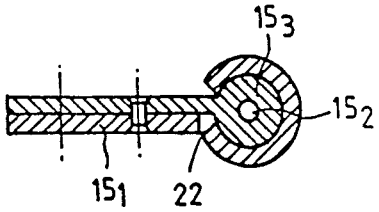
FIG. 5 shows a section along A—A of FIG. 4
Figure 6:
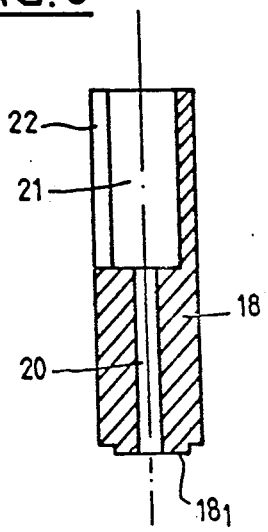
FIG. 6 shows an axial section view of a method of constructing one of the end pieces shown in FIG. 4.

In the example of an embodiment shown in FIGS. 4, 5 and 6, the door or the like is supported by two hinges 15 and 16, the mobile component of which $15_1$, $16_1$ pivots through its pin $15_2$, $16_2$ on the node of the mobile component $15_3$, $16_3$.

The torsion bar 17 connects the fixed component $15_3$ of the hinge 15 to the mobile component $16_1$ of the hinge 16, this connection being effected by means of the end fittings 18 and 19.

These end fittings 18 and 19 are provided with an axial passage 20 of polygonal section for example square which receives in a free sliding arrangement the torsion bar 17 of corresponding section. As a result of this method of assembly, the end fittings 18, 19 are able to slide axially on the torsion bar, whilst being rotationally immobilised on the bar. A housing 21 provided with a lateral slot 22 is provided on one half of the end fittings 18 and 19, whereby this housing 21 is disposed in the extension of the passage 20 of the torsion bar 17. The shape and dimensions of the housing 21 and the slot 22 are chosen so that they can be adapted to the node of one of the components of a hinge.

When this adaptation is effected, the end fitting is held fast on the component of the hinges by the strap hinge of the fixed component $15_3$ or mobile component $16_3$ which passes through the slot 22 of the end piece in question.

With this arrangement therefore, the torsion bar can be fitted simply and rapidly to a door as the end fittings 18, which slide axially on the torsion bar, are immobilised in rotation on this bar by the passages 20 and they are also rotationally immobilised on a fixed or mobile component of a hinge by the slot 22 and its housing 21. A tube 23 which is slit along its length, could also be disposed about the torsion bar between the end fittings 18 and 19 and in this case the end fitting 18, which is adjacent to the upper hinge 15, will be provided at its base with a circular bearing surface $18_1$, which is capable of being housed inside the tube 23 and of centering it on the torsion bar 17. In this arrangement the lower end of the tube 23 is also held coaxially in relation to the torsion bar 17 by a washer 24 provided with a central orifice, the shape of which corresponds to the section of the bar 17, whilst the outside diameter of this bar corresponds to the inside diameter of the tube 23.

I claim:

1. Automatic door closer comprising at least two hinges, each of which comprises two hinged components on an axis and one of which, known as the mobile component, is fixed on the door and the other one of which, known as the fixed component, is fixed on the post of the door, a steel spring torsion bar (17) connecting the fixed component of a hinge to the mobile component of another hinge, so as to bring the door back automatically into the closed position, characterised in that a tube (23) provided with a slot along its length is disposed about the bar (17) between the hinges, said tube being held coaxially on the bar between a washer (24) which is adjacent to the mobile component and a bearing surface which is adjacent to the fixed component, the bar (17) passing freely inside the washer, end fittings (18, 19) being provided at both ends of the tube between the tube and the hinges, said end fittings including an axial through passage (20) having a polygonal cross section, whereby the torsion bar (17) extends through and is rotationally immobilized inside and with the end fitting, the end fittings being provided on one half of its length with a housing (21), said housing being provided with a lateral slot (22) throughout its length, the slot being adapted to fit onto the node of the fixed component of the hinge, the end fittings being displaceable by sliding on the bar inside the tube, the end fitting connected to the fixed component being unitarily provided on one of its ends with the bearing surface for centering the slit tube on the bar.

* * * * *